US008163680B2

(12) United States Patent
Palazzotto

(10) Patent No.: US 8,163,680 B2
(45) Date of Patent: Apr. 24, 2012

(54) METHOD OF DEMULSING A NATURAL GAS DEHYDRATOR

(75) Inventor: John D. Palazzotto, Castro Valley, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 1325 days.

(21) Appl. No.: 11/536,196

(22) Filed: Sep. 28, 2006

(65) Prior Publication Data

US 2008/0081773 A1 Apr. 3, 2008

(51) Int. Cl.
*C10M 169/04* (2006.01)

(52) U.S. Cl. ..... 508/110; 508/501; 508/579; 95/32

(58) Field of Classification Search ..... 508/501, 508/579; 95/32

See application file for complete search history.

(56) References Cited

U.S. PATENT DOCUMENTS

| | | | | |
|---|---|---|---|---|
| 3,009,884 | A | 11/1961 | Monson et al. | |
| 4,111,821 | A | 9/1978 | Lazarus et al. | |
| 4,229,130 | A | 10/1980 | Franklin | |
| 4,302,343 | A | 11/1981 | Carswell et al. | |
| 4,374,734 | A | 2/1983 | Newcombe | |
| 4,867,890 | A | 9/1989 | Colclough et al. | |
| 5,163,981 | A * | 11/1992 | Choi | 95/209 |
| 5,334,329 | A * | 8/1994 | Vinci et al. | 508/194 |
| 5,407,585 | A | 4/1995 | Taylor et al. | |
| 5,453,114 | A | 9/1995 | Ebeling | |
| 5,726,133 | A | 3/1998 | Blahey et al. | |
| 5,906,969 | A | 5/1999 | Fyfe | |
| 6,004,380 | A | 12/1999 | Landreau et al. | |
| 6,140,282 | A | 10/2000 | Cartwright et al. | |
| 6,174,842 | B1 * | 1/2001 | Gatto et al. | 508/364 |
| 6,216,474 | B1 | 4/2001 | Sishtla | |
| 6,217,304 | B1 | 4/2001 | Shaw | |
| 6,255,262 | B1 | 7/2001 | Keenan et al. | |
| 6,506,039 | B1 | 1/2003 | Osumimoto et al. | |
| 6,569,819 | B2 | 5/2003 | Yagishita et al. | |
| 6,955,705 | B1 * | 10/2005 | Cheney et al. | 95/42 |
| 2003/0130534 | A1 * | 7/2003 | Golden | 556/410 |
| 2004/0142827 | A1 * | 7/2004 | Palazzotto et al. | 508/502 |
| 2004/0198615 | A1 | 10/2004 | Friend et al. | |
| 2005/0014656 | A1 * | 1/2005 | Sumiejski et al. | 508/192 |
| 2005/0095718 | A1 | 5/2005 | Wollenberg et al. | |
| 2006/0167321 | A1 | 7/2006 | Haubner et al. | |
| 2007/0155631 | A1 | 7/2007 | Muir | |

FOREIGN PATENT DOCUMENTS

| | | |
|---|---|---|
| WO | WO 2007/005094 A1 | 1/2007 |

* cited by examiner

*Primary Examiner* — Walter D Griffin
*Assistant Examiner* — Taiwo Oladapo

(57) ABSTRACT

Provided is a method of inhibiting the formation of emulsions in a natural gas dehydrator by lubricating the upstream compressors and natural gas engines with a lubricating oil comprising an effective amount of one or more demulsifiers. Provided is also a method of lubricating the upstream compressors and natural gas engines with the same oil compositions.

19 Claims, No Drawings

METHOD OF DEMULSING A NATURAL GAS DEHYDRATOR

The present invention relates to a method of demulsing natural gas glycol dehydrators and downstream machines at natural gas field processing sites. More particularly, the present invention relates to the inclusion of one or more demulsifiers in oil compositions that may be used to lubricate machines upstream from the dehydrators. Even more particularly, the present invention relates to using the same oil compositions to lubricate both the natural gas compressors and the engines that power those compressors.

BACKGROUND OF THE INVENTION

With global oil production moving from plateau to decline, worldwide reserves of natural gas take on added importance. Increasingly, natural gas is viewed as a vital alternative energy source because it is plentiful and burns cleaner than other fossil fuels.

Methane is the primary component of natural gas. It is believed that methane is produced during the conversion to coal from peat, which is formed by continuous sub-aqueous deposition of plant-derived organic material in environments where the interstitial waters are oxygen-poor. In addition to methane, lesser amounts of other compounds such as water, nitrogen, carbon dioxide, and heavier hydrocarbons, and sometimes small amounts of other fluids such as argon and oxygen, can be found within the carbonaceous matrix of the coal formation. The gaseous fluids produced from coal formations are often collectively referred to as "coalbed methane." Coalbed methane typically comprises more than about 90 to 95 volume percent methane. According to the U.S. Geological Survey, the reserve of such coalbed methane in the United States and around the world may be over 700 trillion cubic feet and over 7,500 trillion cubic feet, respectively. Most of these reserves are found in coal beds, but significant reserves are also found in other solid carbonaceous subterranean formations.

After natural gas is extracted from coalbeds but before it can be transported through the pipeline to a refinery, it must undergo a complicated process at or near the wellhead to remove various corrosion-causing contaminants. Depending on the well location and the geological conditions that created the natural gas in the first place, the raw gas emerging from the wellbore usually contains various amounts of water vapor; natural gas liquids such as ethane, propane and butane; hydrogen sulfide; carbon dioxide; helium; nitrogen; and other compounds. Various other contaminants are often introduced into the raw gas during the drilling and extraction of such gas from the coal seams. These other contaminants may include, for example, a pad fluid that is pumped down the wellbore into the coal-containing formation to initiate and propagate fractures in the formation. They may further include soaps and chemicals that are introduced into the wells to enhance production, especially during the "workover" of a wellbore when the well has reached the natural, downward slope of its production curve.

The process through which the raw natural gas is perliminarily purified at or near the wellhead is termed "field processing." Field processing is carried out with clusters of machines. Each cluster typically includes one or more slug catchers, one or more compressors, a dehydrator, as well as one or more process water tanks. In certain field processing procedures, the raw gas first passes through a "slug catcher," which roughly separates the liquid and gas phases. The liquid phase, which comprises essentially water and salts, is then sent to the process water tank, where the water may be treated and/or released into the ground. The gas phase is filtered to reduce the presence of pipeline scale that is introduced by the drilling equipment, and coal fines that inevitably accompany the raw gas as it is released from the fractured coal beds. The filtration in the slug catcher may be carried out with, for example, PECO™ PCHG-536 filter cartridges.

Downstream from the slug catcher, the extracted natural gas usually passes through a compressor, which may be either a reciprocating compressor or a rotary compressor. A reciprocating compressor comprises a cylinder and a piston. Compression is accomplished by the change in volume as the piston moves toward the "top" end of the cylinder. As the gas volume is decreased, there is a corresponding increase in pressure. Reciprocating compressors are thus known as positive-displacement-type compressors. Examples of reciprocating compressors include ARIEL™ reciprocating compressor JGK/4.

The gas stream from the slug catcher may instead pass through a rotary compressor, for example, a rotary screw compressor, which is likewise a positive-displacement compressor. There are several types of rotary screw compressors, including the rotary screw, lobe, and vane compressors. These compressors are described, for example, in U.S. Pat. Nos. 6,506,039, 6,217,304, and 6,216,474, the disclosures of which are incorporated herein by reference. A rotary screw compressor usually comprises one set of male and female helically grooved rotors, a set of axial and radial bearings, and a slide valve, all of which are encased in a common housing. As the rotors begin to un-mesh, the male rotor lobe rolls out of the female rotor flute. The volume vacated by the male rotor is then filled with gas. After the suction step, the compression process begins, during which the rotors continue to rotate and mesh together along the bottom, as the male motor lobe moves into the female flute and reduces the volume in the flute. The compression process continues until the compressed gas is discharged through the discharge port.

The compressors can be either single-stage or multiple-stage compressors. Multiple-stage compressors have a minimum of two pistons, and require two or more stages to reach the final output pressure, the output of one stage being the input to the next. Cooling the air between stages improves compressor efficiency.

Alternatively, a compressor of either type, typically a rotary screw compressor, may be placed upstream from the slug catcher as a wellhead booster, especially when the natural gas field exhibits declining pressure. Rotary screw compressors are often used for this purpose because they are designed for low pressure applications with inlet pressures up to 100 psig and discharge pressures up to 350 psig. In this case then, the gas stream entering the slug catcher already has reduced volume and increased pressure as compared to when it has first emerged from the wellhead.

Most if not all compressors are designed to operate with lubrication, although the specific ways lubricating oils are introduced depend on the compressor type. For example, the lube oil for a rotary screw compressor is injected in several locations with the main oil injection port, feeding the rotors directly and with smaller lines feeding to the points for seals and bearings. Injected oil will then drain the rotors where it combines with the gas, and the gas/oil mixture is then discharged from the compressor. On the other hand, for a reciprocating compressor, the lubricating oil is fed directly to the cylinder parts, including the pistons, piston rings, cylinder liners, cylinder packing and valves. Sometimes, the lubricating oil is also used as a coolant for the compressor cylinders and the running parts such as the main bearing, wristpin, crankpin, and crosshead pin bearings.

At or near the wellheads, the engines used to drive the compressors are typically natural gas engines, largely due to the ready access to natural gas and the often remote locations of these fields. This approach eliminates the need to transport fuels to, or otherwise provide means to power, the engines in remote areas. Examples of natural gas engines used in the field include the WAUKESHA™ engines.

Despite the initial phase separation in the slug catcher, the gas stream flowing into the downstream machines continues to be contaminated with water vapor. This is because natural gas produced from low-pressure wells normally has large amounts of saturated water vapor entrained therein. It is also thought that gas from newly installed wells may even be "wetter." Dehydration thus must first occur before the wet gas enters the pipeline, because water is the predominant cause of corrosion and other water-related damage in pipelines and storage containers. Dehydration of the natural gas can take place by either of two processes: absorption or adsorption. Absorption occurs when the water vapor is taken out by a dehydrating agent. Adsorption occurs when the water vapor is condensed and collected on the surface.

The most common gas dehydration system and an example of absorption dehydration is a glycol dehydrator. The process of glycol dehydration is described, for example, in U.S. Pat. Nos. 5,453,114, 6,004,380, 5,536,303, 5,167,675, and 6,238,461, the disclosures of which are incorporated herein by reference. In this system, a liquid glycol desiccant serves to absorb water from the gas stream. Glycol has a chemical affinity for water. Thus, when in contact with a stream of water-containing (or wet) natural gas, the glycol "steals" the water out of the gas stream. Glycol solutions that may be used as liquid desiccants include, for example, diethylene glycol (DEG), triethylene glycol (TEG) and tetraethylene glycol. These glycol solutions are brought into contact with the wet gas stream in a contactor, wherein the glycol solutions absorbs water from the wet gas. The glycol fluid may be cooled by a cooler situated in the dehydrator itself, or after the compressors but before the dehydrator. As the water-logged glycol particles become heavier and sink to the bottom of the contactor, they can be removed form the contactor. The glycol solution is then put through a specialized boiler designed to vaporize only the water out of the solution. While water has a boiling point of 212° F., glycol does not boil until 400° F. This boiling point differential makes it relatively easy to "dry" the glycol solution, allowing it to be regenerated for future use. The ability to regenerate the glycol solution is particularly important in field processing of natural gas because the wellheads are often in remote locations.

Solid-desiccant dehydration, which constitutes an example of adsorption, provides another way of removing water vapor from wet natural gas. Solid-desiccant dehydrators usually comprise two or more adsorption towers filled with one or more solid desiccants. Typical desiccants include, for example, activated alumina and granular silica gel materials. As wet natural gas passes through the desiccant towers, from top to bottom, the water vapor is retained by the desiccant particles, leaving the "dry" or "drier" gas to exit via the bottom of the tower. While solid-desiccant dehydrators can be more effective than glycol dehydrators, they are not widely used because of the limited capacity and low saturation thresholds of the desiccants, and the need for frequent regeneration. Some solid desiccants, once saturated, cannot be regenerated to remove water, and thus must be discarded. The added burden of disposal, together with the storage and transportation difficulties, make solid desiccant systems impractical for natural gas field processing. The present invention therefore relates to situations where a liquid desiccant, especially a glycol desiccant, is in the dehydrator.

The dehydrator tends to become the collection point where a variety of materials come together. These materials may include those that had originally been part of the extracted natural gas but have yet to be removed. These materials may also include those that are introduced into the gas as the result of upstream processing steps. For example, the compressors and the natural gas engines that power those compressors often introduce materials such as mineral oils and chemicals form their lubricants and additives. These materials then cling to the natural gas as the latter reaches the dehydrator. It has been found that these contaminating materials, together with other remnants such as soaps, residual pipeline scale and coal fines, substantially emulsify under the wet gas stream. Thick emulsions and sometimes even sludges would form, clogging the dehydrators and other downstream machines, and causing the pressures therein to rise unacceptably. The thick emulsions may prevent the flow of glycol desiccants to the reboiler unit where the desiccants may be regenerated or recycled for future use. They may also prevent the proper channeling of the processed gas to the pipeline. Consequently, the dehydrators and other downstream machines must be cleaned out, and the glycol supplies must be replaced frequently, to avoid damaging the draining mechanisms and the machines housing these mechanisms. These requirements are undesirable, from both economic and practical standpoints, especially because field processing of natural gas mostly takes place in remote areas.

To remove the emulsion buildups, it is theoretically possible to install additional components or machines upstream from the dehydrators that would demulse by settling, heating, centrifugation, or subjecting the emulsions to electrical fields. However, most water-in-oil emulsions, such as those typically formed in the dehydrators, are too stable to be broken solely by the mechanical processes mentioned above with adequate timeliness. The use of chemical demulsifiers has proven more satisfactory in other instances where water-in-oil emulsions are problematic.

Demulsifiers are typically added to oil formulations to facilitate the separation of water containments from the oils and oil-soluble additives. They tend to concentrate at the oil-water interface and promote coalescence of the water droplets. The use of demulsifiers to break up water-in-oil emulsions is known, just as it is known that the presence of water-in-oil emulsions often leads to corrosions and to the growth of microorganisms in the water-wetted parts of the pipelines and storage tanks.

Desirable properties in demulsifiers include: (1) rapid breakdown into water and oil with minimal amounts of residual water in the oil phase; (2) good shelf-life; and (3) easy preparation. Certain nitrogen-containing compounds are known to be suitable demulsifiers for water-in-oil emulsions. For example, U.S. Pat. No. 4,153,564 disclosed demulsifiers that were the reaction product of an alkenylsuccinic anhydride or acid and an aniline-aldehyde resin, and the reaction product of an alkenylsuccinic anhydride and an aromatic trazole. U.S. Pat. No. 4,743,387 disclosed certain polyoxyalkylenediamines are demulsifiers. These nitrogen-containing demulsifiers were typically made by condensation of the amino groups with the carboxylic entities of acids. The long polyether chains and bulky 3-D structures of acids were found to be particularly suitable characteristics in demulsifier precursors.

Phosphorus-containing compounds are also known to have demulsifying properties in some instances, for example, in U.S. Pat. No. 4,229,130.

Other known water-in-oil demulsifiers include polyalkylene glycol and its derivatives. For example, U.S. Pat. No. 4,374,734 disclosed using polyoxypropylene polyol to break water-in-oil emulsions, wherein the emulsions were formed as a result of surfactant flooding in a process related to oil production from wells. The preferred molecular weights for the polypropylene polyols were said to be between 2,000 to 4,500. U.S. Pat. No. 3,835,060 taught conventional demulsifiers such as polyoxyalkylene glycol and polyoxyethylene-polyoxypropylene block polymers. U.S. Pat. No. 3,577,017 disclosed water-in-oil demulsifiers comprising ultra-high-molecular-weight (at or above 100,000) polymers. The polymers of that invention were selected from polyoxyalkylene polymers and copolymers of monomeric alkylene oxides having a single vicinal epoxy group. Furthermore, U.S. Pat. No. 5,407,585 disclosed a water-in-oil emulsions demulsifier that was a derivative or adduct of a high-molecular-weight polyalkylene glycol and ethylene oxide or diglycidyl ether. Methods of making polyoxyalkylene glycols are known in the art. For example, pending U.S. patent application Ser. No. 10,524,555 (published as U.S. 2006/0167321) disclosed a process of making such a copolymer by distilling water out of a reaction mixture comprising tetrahydrofuran and alpha, omega diols in the presence of a heteropolyacid and a hydrocarbon. The disclosures of the cited patent applications are incorporated herein by reference.

Demulsification, though important, is however not the sole concern at remote field processing sites. Further considerations should be given to formulating a set of lubricating oils that are compatible for the compressors as well as the engines that power those compressors. This is because, at these remote sites, it is desirable to use the same oils to lubricate the compressors and the engines.

Conventional lubricating oils are machine-specific. For example, with limited exceptions of some polyalphaolefin (PAO) and ester-based products, oils made with synthetic base stocks often cannot be mixed with products made with mineral oils even if they are designed for the same application. Moreover, some lubricants are incompatible because of differences in additive chemistry that might lead to undesirable chemical reactions, forming insoluble materials and depositing on sensitive machine surfaces. In its mildest form, adding the wrong lubricating oils to the equipment may lead to a degradation of lubricant performance. Even in that instance, however, unless the machine has never been previously oiled, the wrong lubricating oil is typically added to a vessel that already contains small amounts of the correct lubricating oil. Mixing the same grades of oils might not damage the engine, but it almost certainly will impede performance features that are provided by the intended lubricating oils. At the other end of the spectrum, adding the wrong oil to certain equipment may spell disaster, causing serve deposits, wear and filter plugging, and resulting in extensive damages.

A synchronized approach that lubricates compressors and engines with the same interchangeable oils would eliminate the risks associated with applying the wrong lubricating oils. This approach is especially desirable because it also avoids the need to stock different types of lubricating oils at or near the wellheads. This invention therefore further provides the method of using a single lubricating oil composition for the compressors and the natural gas engines that drive those compressors.

SUMMARY OF THE INVENTION

It has been found that adding demulsifiers to the oils that lubricate the compressors and/or the engines that power those compressors competently removes the buildup of emulsions in the dehydrators and other downstream machines.

In a first aspect, the present invention provides lubricating oil compositions that are suitable for use in natural gas compressors as well as natural gas engines, said compositions comprise small amounts of dispersants and metal-containing detergents, and one or more demulsifiers in an effective amount to inhibit or reduce the formation of emulsions in the glycol dehydrators and other downstream machines.

In a second aspect, the invention provides a method of lubricating the natural gas compressors and/or the natural gas engines using the compositions of the first aspect at or near a natural gas wellhead, so that no emulsion or lower levels of emulsions may form in the dehydrators and other machines downstream.

In a third aspect, the invention provides a method of lubricating the compressors and the engines that power those compressors with the same, interchangeable compositions of the first aspect, so as to inhibit the formation of emulsions in the dehydrators while avoiding lubricant mix-ups during field processing.

Persons skilled in the art will understand other and further objects, advantages, and features of the present invention by reference to the following descriptions.

DETAILED DESCRIPTION OF THE INVENTION

Various preferred features and embodiments are described below by way of non-limiting illustrations.

The present invention provides compositions as described above. The compositions are compatible for use in the natural gas processing fields with natural gas compressors and natural gas engines that power the compressors. Furthermore, the compositions of the present invention comprise an amount of one or more demulsifiers that are sufficient and competent to inhibit or reduce the amount of emulsions formed in the dehydrators and other downstream machines.

As discussed above, natural gas-fired engines are typically used in the oil and gas industry to compress natural gas at wellheads and along pipelines. This practice requires the engines to run continuously at or near full load, shutting down only for maintenance procedures such as oil changes. The need to run continuously near full load places severe demands on the suitable lubricating oils for those engines.

The increased operating severity has first lead to added incidents of engine exhaust valve wear commonly known as "valve recession" or "valve sink." These terms refer to the rapid wear of the exhaust valves and/or the exhaust valve seats experienced by engines operating under high load conditions. It is known in the art that metallurgical improvements in valve and valve seat materials did little to relieve the wear. Certain lubricating oils, on the other hand, were found to effectively resolve the valve recession problem. U.S. Pat. No. 3,798,163, for example, disclosed a composition as well as a method of maintaining a lubricating amount of an oil composition comprising a base oil of lubricating viscosity; at least one alkaline earth metal sulfonate in an amount sufficient to improve the detergency of the composition; and at least one alkaline earth metal salt of a condensation product of an alkylene polyamine, an aldehyde, and a substituted phenol, in an amount sufficient to inhibit recession of the engine's exhaust valve into the engine's cylinder head.

Moreover, because the lubricating oils used with these engines are subject to high temperatures, the lives of the oils are often limited by oxidation. Additionally, natural gas engines run with high emissions of nitrogen oxides. Thus, the lives of the lubricating oils may also be limited by nitration. Accordingly, it is desirable that the gas engine oils have long life through enhanced resistance to oil oxidation and nitration. Engine oils having the desirable levels of resistance have been described in the prior art. For example, U.S. Pat. No. 5,726,133 disclosed a long-life and low-ash gas engine oil that has improved oxidation- and nitration-resistance. That oil comprised a major amount of a base oil of lubricating viscosity; and a minor amount of an additive mixture selected from at least one alkali or alkaline earth metal salt having a total base number (TBN) of about 250 or less, and a second alkali or alkaline earth metal salt having a TBN of about 125 or less. Moreover, U.S. Pat. No. 6,140,282 disclosed another long-life, low-ash gas engine oil that comprised a major amount of a base oil of lubricating viscosity; and a minor amount of a mixture of several metal detergents, such as a metal salicylate detergent, a metal sulfonate detergent, and/or a metal phenate detergent.

On the other hand, the combustion of natural gas is often complete, generating virtually no incombustible materials. Thus the durability of the cylinder head and valve is controlled by the properties of the lubricant and its consumption rate. Consequently gas engines typically have specific ash content requirements because it is the ash that acts as a solid lubricant and protect the valve/seat interface. Running the engine with too low an ash level results in shortened life for the valves or cylinder head, while running the engine with too high an ash level causes excessive deposits in the combustion chamber and piston areas. Accordingly, the ash level is often the focus in formulating natural gas engine oils.

In comparison, natural gas compressors have their own lubrication needs. The factors to consider in formulating compressor lubricants may or may not overlap those in formulating gas engine lubricants. Compressor lubricants must protect rotating bearing and/or sliding screws, pistons, crankcase components and other parts. Depending on the compressor design and type, high temperatures may be generated from adiabatic compression or friction of moving parts. Adequate thermal and oxidative stabilities are therefore required for compressor lubricants, just as they are required for gas engine oils. Rust and oxidation inhibited lubricants are also desirable, and antiwear protection is often needed.

Lubrication requirements differ with different compressors because of their distinct structural features. For example, lubricants that are used in reciprocating gas compressors must have two separate functions: (1) providing lubrication for the crankshaft and other portions of the drive train and transmission parts for the compressor; and (2) providing lubrication for the compression chamber. The lubrication of the drive train and transmission requires a stable material that retains its viscosity and lubricating properties under various severe operating conditions. Materials meeting these requirements include, for example, high-performance ester-based lubricants that have been disclosed in the prior art as turbine engine lubricants or oils for jet aircraft engines. The second function, i.e., providing lubrication of the compression chamber, is specific to this type of compressor. Unlike lubricants for internal combustion engines, the cylinder lubricant in reciprocating gas compressors is injected into the piston chamber, is not recycled subsequently, and exits with the compressed gas. Thus, lubricants for these compressors must not only have high resistance to degradation under extreme temperatures and pressures, but also refrain from forming sludge or varnish in the valves. They must also be effective in small amounts in order to avoid excessive contamination of the exhaust compressed gas. In addition, lubricants for reciprocating compressors must have low vapor pressure and good viscosity stability. An example of a suitable lubricating oil composition for a reciprocating compressor was disclosed in U.S. Pat. No. 4,111,821.

In the rotary screw compressors, rotors are exposed to a mixture of gas and the lubricant. In addition to providing a thin film on the rotor to prevent metal-to-metal contact, the lubricant must provide a sealing function to prevent gas recompression, which occurs when high-pressure, hot gas escapes across the seals between the rotors and other meshing surfaces and is compressed again. The lubricating oils for these compressors often serve as coolants, removing the heat generated during gas compression. These oils must also be suitable for lubricating the bearings at the inlet and outlet of the compressors. And because the lubricants are in contact with the gas being compressed in these compressors, the lubricants experience high shearing force between the intermeshing rotors. Suitable lubricating oil compositions for rotary screw-type of compressors have been disclosed in the prior art, for example, in U.S. Pat. No. 4,302,343.

A conventional gas engine lubricant therefore may not necessarily be suitable for use interchangeably with a compressor. However, in accordance with the present invention, a person skilled in the art will be able to formulate lubricating oil compositions that are suitable for such interchangeable uses without undue experimentation, because the criteria against which the performances of the desired compositions are evaluated are known.

Base Oils

The lubricating oil composition of the present invention typically comprises one or more base oils that are present in a major amount (i.e., an amount greater than about 50 wt. %). Generally the base oil is present in an amount greater than about 60 wt. %, or greater than about 70 wt. %, or greater than about 80 wt. %, based on the total mass of the lubricating oil composition. The base oil used in the lubricating composition of the invention may be a natural oil, a synthetic oil, or a mixture thereof, provided that the oil exhibit the requisite thermal stability and resistance to oxidation and nitration. Base oils contemplated for use with the present invention include animal, vegetable, mineral or synthetic hydrocarbon oils of lubricating viscosity and mixtures thereof. Synthetic hydrocarbon oils include long-chain alkanes such as, for example, cetanes, and olefin polymers such as, for example, oligomers of hexene, octene, decene, and dodecene. Synthetic oils may also include (1) fully esterified ester oils, with no free hydroxyls, such as pentaerythritol esters of monocarboxylic acids having 2 to 20 carbon atoms, trimethylol propane esters of monocarboxylic acids having 2 to 20 carbon atoms; (2) polyacetals; and (3) siloxane fluids. Especially useful among the synthetic esters are those made from polycarboxylic acids and monohydric alcohols. Particularly preferred are the ester fluids made by fully esterifying pentaerythritol or its mixtures with di- and tripentaerythritol, with an aliphatic monocarboxylic acid containing from 1 to 20 carbon atoms.

Mineral oils are cost effective for applications where high-temperature stability is not required. Mineral oils may also be processed to reduce sulfur content, but hey generally contain residual sulfur in amounts of about 0.1 to 0.5 wt %. For this reason, synthetic base lubricating oils are preferred for the present invention because they are free of residual sulfur. Suitable synthetic base oils include, for example, polyalphaolefin (PAO) oils, ester (diester and polyolester) oils, polyalkylene glycol oils or mixtures having a kinematic viscosity of about 2 to 10 cSt at 100° C. These synthetic base oils are inherently free of sulfur, phosphorus and metals.

Polyalphaolefin oils can be prepared by the oligomerization of 1-decene or other lower olefin to produce high viscosity index lubricant range hydrocarbons in the $C_{20}$ to $C_{60}$ range. Other lower olefin polymers include, for example, polypropylene, polybutylenes, propylene-butylene copolymers, chlorinated polybutylenes, poly(1-hexenes), poly(1-octenes), alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and the derivatives, analogs and homologs thereof.

Polyalkyleneglycol oils can be prepared by polymerization of alkylene oxide polymers and interpolymers and derivatives, wherein the terminal hydroxyl groups have been modified by a process such as esterification and etherification. Examples include polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1,000, diphenyl ether of polyethylene glycol having a molecular weight of 500-1,000, diethyl ether of polypropylene glycol having a molecular weight of 1,000-1,500); and mono- and polycarboxylic esters thereof, for example, the acetic acid esters, mixed $C_3$-$C_8$ fatty acid esters, and $C_{13}$ Oxo acid diester of tetraethylene glycol.

The ester oils may also serve as the solubilizing media between the synthetic lubricating base oils and the additive compositions. The ester oil may comprise, for example, an aliphatic diester of an aliphatic dicarboxylic acid, which may be selected from: phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, and alkenyl malonic acids. The alcohol precursors of the esters may include, for example, butyl alcohol, hexyl alcohol, dodecyl alcohol, 2-ethylhexyl alcohol, ethylene glycol, diethylene glycol monoether, propylene glycol. Specific examples of suitable esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting 1 mole of sebacic acid with two moles of tetraethylene glycol and 2 moles of 2-ethylhexanoic acid.

Esters useful as synthetic oils also include those made from $C_5$ to $C_{12}$ monocarboxylic acids and polyols and polyol esters, such as, for example, neopentyl glycol, trimethylolpropane, pentaerythritol, dipentaerythritol and tripentaerythritol.

Additives

The additives that may be included in the lubricating oil compositions of the present invention include an effective amount of one or more demulsifiers to inhibit the formation or buildup of emulsions in the dehydrators and other machines that are downstream from the dehydrators. Additives suitable for the present invention may also include one or more of: viscosity index improvers, corrosion inhibitors, oxidation inhibitors, dispersants, lube oil flow improvers, detergents and rust inhibitors, pour point depressants, anti-foaming agents, anti-wear agents, seal swellants, friction modifiers, extreme pressure agents, color stabilizers, wetting agents, bactericides, and additive solubilizers. Some but not all of the suitable additives are described below. Persons skilled in the art will be able to select other additives without undue experimentation.

Using demulsifiers to break water-in-oil emulsions are well known in the art, especially in the arena of crude oil production. It is known that demulsifiers break emulsions of polar solutes like water, and non-polar solvents like oil. They are commonly used in functional fluids (e.g., metal removal fluids, greases, rust and oxidation fluids, hydraulic oils, compressor oils, fuels, and transformer fluids) to inhibit formation of emulsions, break emulsions that have developed, and inhibit corrosion.

In their broadest conception, demulsifiers are made of amphiphilic compounds. See, e.g., Kwetkat et al., U.S. Pat. No. 5,997,610. The hydrophilic portion of a demulsifier may contain formally charged residues such as cationic, anionic, zwiterionic residues, or it may contain uncharged, polarized residues. The hydrophobic portion of a demulsifier may include long alkyl functional groups (>7 carbons), alkyl aryl functional groups, petroleum derivatives, or even polysiloxane functional groups.

The ASTM D-1401 is a standardized test typically used to evaluate the general effectiveness of a compound as a demulsifier. A description of this test may be found in the Annual Book of ASTM Standards, Vol. 05.01, which is incorporated herein by reference. ASTM D-1401 tests the relative speed and extent of demulsification among different demulsifiers. The standard ASTM D-1401 test procedure calls for the mixing of 40 mL of an oil phase and 40 mL of an aqueous phase (typically deionized water), followed by a period of time to allow the phases to separate. The results to ASTM D-1401 are usually expressed in the form O/W/E (T), where the O is the volume of the oil phase, W is the volume of the aqueous phase, E is the volume of the emulsion layer, and T is the time it takes to achieve stable separation of the two phases. The standard test is performed at 54° C. The standard testing conditions, however, are preferably modified to mimic the conditions under which the lubricating oil compositions and the demulsifiers contained therein will function. Specifically, the testing temperature is preferably lowered to about 20 to 27° C., and most preferably to about 24 to 25° C. Moreover, the aqueous solution added to form the test mixture is preferably a brine solution rather than distilled water because the constitution of a brine solution more closely resembles that of the emulsions. Particularly preferably, the proportion of the brine solution is adjusted so that the concentrations of the components in the test mixture mimic those in the actual emulsions.

The demulsifiers of the present invention may be selected from known demulsifiers that are stable and functional under various temperatures. Preferably, the demulsifiers of the present invention demonstrate good performance in the ASTM D-1401 test at the lower, modified testing temperatures, which simulate the actual operating temperatures in the dehydrators. Demulsifiers of the present invention are preferably low-ash, or most preferably ashless, to avoid clogging filters and orifices of the compressors and the engines. Such ashless demulsifiers may be based upon amine sulfonates, amine sulfates, amine phosphates, and amine carboxylates. The demulsifiers are preferably low foaming, with low viscosity and/or have the capacity to inhibit corrosion. An exemplary embodiment of the present invention comprises a polyoxyalkylene glycol as the demulsifier.

The amount of demulsifiers used in the lubricating oil compositions of the present invention may vary substantially. At the minimum, however, the amount of demulsifiers must be sufficient to inhibit or reduce the formation of emulsions in the dehydrators and other downstream components, for example, from about 0.01 to 2.0 wt. %, or preferably from about 0.1 to 1.0 wt. %, based on the total mass of the lubricating oil composition. Exemplary embodiments of the present invention comprise about 0.01 to 1.0 wt. % of demulsifiers, based on the total weight of the lubricating oil composition.

In addition to the demulsifiers, oxidation inhibitors or antioxidants may be added to the lubricating oil compositions of the present invention because they reduce the tendency of base stocks to deteriorate in service, prevent the increase in viscosity, and avoid sludge or varnish deposits on metal surfaces. Such oxidation inhibitors may include one or more of hindered phenols, alkaline earth metal salts of alkylphenolthioesters having preferably $C_5$ to $C_{12}$ alkyl side chains, calcium nonylphenol sulfide, ashless oil-soluble phenates and sulfurized phenates, phosphosulfurized or sulfurized hydrocarbons, phosphorous esters, metal thiocarbamates, and oil-soluble copper compounds such as those described in U.S. Pat. No. 4,867,890. Phenols that are useful for this purpose include various alkylated phenols, hindered phenols and phenol derivatives such as t-butyl hydroquinone, butylated hydroxyanisole, polybutylated disphenol A, butylated hydroxy toluene, alkylated hydroquinone, 2,5-ditert-aryl hydroquinon 2,6-ditert-butyl-para-cresol, 2,2'-methylenebis (6-tert-butyl-p-cresol); 1,5-naphthalenediol; 4,4'-thiobis(t-tert-butyl-m-cresol); p,p-biphenol; butylated hydroxy toluene; 4,4'-butylidenebis(6-tert-butyl-m-cresol); 4-methoxy-2, 6-di-tert-butyl phenol; and the like. Amino antioxidants include aldehyde amines, ketone amines, ketone-diarylamines, alkylated diphenylamines, phenylenediamines and the phenolic amines. An exemplary embodiment of the present invention comprises an overbased, sulfurized calcium phenate and an IRGANOX™ L-135 hindered phenolic propionate ester as antioxidants.

Frictional modifiers may also be included to improve efficiency of the natural gas engines and the compressors. Oil-soluble alkoxylated mono- and di-amines are well known frictional modifiers. The amines may be used as such or in the form of an adduct or reaction product with a boron compound, which may be, for example a boric oxide, boron halide, metaborate, boric acid or a mono-, di or tri-alkyl borate. Among other frictional modifiers, there may be esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols have been described in U.S. Pat. No. 4,702,850. Further examples of other conventional friction modifiers, including the often-used organo-metallic molybdenum, have been described by M. Belzer in the *Journal of Tribology*, Vol. 114, pp. 675-682 (1992), and M. Belzer and S. Jahanmir in *Lubrication Science*, Vol. 1, pp. 3-26 (1998).

The lubricating oil compositions of the present invention may also comprise a rust or corrosion inhibitor, which may be selected from nonionic polyoxyalkylene polyols and esters thereof, polyoxyalkylene phenols, and anionic alkyl sulfonic acids. Moreover, copper- and lead-bearing corrosion inhibitors may be used, but are typically not required with the formulation of the present invention. Examples of such compounds include thiadiazole polysulfides containing from 5 to 50 carbon atoms, their derivatives and polymers thereof, such as those described in U.S. Pat. Nos. 2,719,125; 2,719,126; and 3,087,932. Other additives, such as the thio and polythio sulfenamides of thiadiazoles described in UK. Patent Specification No. 1,560,830, and benzotriazoles derivatives may also fall within this class of additives. When these compounds are included in the lubricating composition, they are typically present in an amount not exceeding 0.5 wt % active ingredient.

Dispersants are also added to the lubricating oil compositions of the present invention. Preferably, the dispersants are of the ashless variety. Ashless dispersants typically comprise oil-soluble polymeric hydrocarbon backbones with attached functional groups that are capable of associating with the particles to be dispersed. The functional groups may be, for example, amines, alcohols, amides, and ester polar moieties, and they are attached to the polymer backbones via bridging groups. Suitable ashless dispersants may be, for example, selected from oil-soluble salts, esters, amino-esters, amides, imides, and oxazolines of long-chain hydrocarbon-substituted mono- and dicarboxylic acids or their anhydrides; thiocarboxylate derivatives of long-chain hydrocarbons; long-chain aliphatic hydrocarbons having a polyamine attached directly thereto; and Mannich condensation products formed by condensing long-chain substituted phenols with formaldehydes and polyalkylene polyamines. An exemplary embodiment of the present invention employs a bissuccinimide ashless dispersant.

Viscosity index modifiers may also be added to the lubricating oil compositions of the present invention. These additives impart high- and low-temperature operability to lubricating oils. They may be the sole-function type or may be multifunctional. Suitable viscosity modifiers include, for example, polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Metal-containing or ash-forming detergents function both as detergents to reduce or remove deposits and as acid neutralizers or rust inhibitors. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by standard detergency tests such as ASTM D-2896. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Suitable detergents include oil-soluble neutral and overbased sulfonates, phenates, sulfurized phenates, thiophosphonates, salicylates, naphthenates, and other oil-soluble carboxylates of a metal, particularly the alkali or alkaline earth metals. The most commonly used metals are calcium and magnesium sometimes also mixed with sodium, which may all be present in certain detergents. Particularly suitable metal detergents are neutral and overbased calcium sulfonates having TBN of from 20 to 450 TBN, and neutral and overbased calcium phenates and sulfurized phenates having TBN of from 50 to 450. An exemplary embodiment of the present invention comprises an overbased sulfurized calcium phenate with a TBN of about 120, as well as a low overbased sulfonate with TBN of about 20.

Pour point depressants, otherwise known as lube oil flow improvers, lower the minimum temperature at which the fluid will flow or can be poured. Such additives are well known. Examples of those additives include $C_8$ to $C_{18}$ dialkyl fumarate/vinyl acetate copolymers, polyalkylmethacrylates, and the like.

Dihydrocarbyl dithiophosphate metal salts are conventionally used as anti-wear and antioxidant agents. The zinc salts are the most commonly used in lubricating oil in amounts of 0.1 to 10, preferably 0.2 to 2 wt. %, based upon the total weight of the lubricating oil composition. An exemplary embodiment of the present invention comprises about 4.5 mM zinc (II) bis(O,O'-di(2-ethyl-1-hexyl)dithiophosphate) as an antiwear agent.

Foam control can be provided by many compounds including an antifoamant of the polysiloxane type, for example, silicone oil or polydimethyl siloxyane. An exemplary embodiment of the present invention comprises about 5 ppm of a silicon-based foam inhibitor in the lubricating oil composition.

Some of the above-mentioned additives can provide a multiplicity of effects. Thus for example, a single additive may act as a dispersant as well as an oxidation inhibitor. Multifunctional additives are well known in the art.

The lubricating compositions of the present invention are formulated by known methods. The formulating is typically carried out continuously at the additive manufacturing plant or blend facility. Alternatively, the compositions can be formulated in a semi-works by hand. The components of the additive composition are weighed individually on a scale and added to an amount of base oil in a steam-jacketed stainless steel kettle at or above ambient temperature, with stirring. When a homogeneous mixture is achieved, the base lubricating is added gradually, with continuous stirring. The result if the final lubricating oil composition, which is then packaged and shipped to point of use. At the point of use, the gas engine or the crankcase of a gas compressor is drained and then refilled with the lubricating oil composition of the invention.

Often all the additives, except for the viscosity modifier, are blended into a concentrate or additive package that is subsequently blended into base stock to make finished lubricant. Use of such concentrates is conventional and well known. The concentrates are formulated to contain the additives in proper amounts so as to provide the desired concentration in the final formulation when the concentrate is combined with a predetermined amount of base oils. The concentrate is preferably made in accordance with the method described in U.S. Pat. No. 4,938,880.

The present invention provides a method of inhibiting the formation of emulsions in a natural gas dehydrator and other downstream field processing machines by lubricating the compressors and the engines powering the compressors with a lubricating oil composition comprising:

- a major amount of a base oil of lubricating viscosity;
- one or more detergents,
- one or more dispersants,
- one or more antioxidant,
- one or more anti-wear agents, and
- one or more demulsifiers in an amount sufficient to inhibit the formation of emulsions in the natural gas dehydrators and other downstream field processing machines.

The lubricating oil composition may also comprise one or more suitable additives selected from: a friction modifier, a viscosity index improver, a foam inhibitor, a rust/corrosion inhibitor, a pour point depressant, and the like.

The term "inhibiting the formation of emulsions" means reducing the level of emulsions or completely eliminating the formation of emulsions in certain machine compartments and vessels.

The invention will be further understood by referencing the following examples, which are not to be construed as limitative of its scope.

EXAMPLES

The following examples are provided to illustrate the present invention without limiting it. While the present invention has been described with reference to specific embodiments, this application is intended to encompass those various changes and substitutions that may be made by those skilled in the art without departing from the spirit and scope of the appended claims.

Example 1

Oils A and B were prepared and tested for demulsing capabilities according to the modified, lower-temperature version of a standard ASTM D-1401 test. The components of Oils A and B are listed in Tables 1 and 2, respectively:

TABLE 1

| Oil A | | |
|---|---|---|
| Components | Concentration in the Concentrate | Concentration in the Finished Oil |
| Low overbased sulfonate detergent | 8.50 wt. % | 3.00 mM (0.51 wt. %) |
| Overbased & sulfurized calcium phenate detergent | 17.99 wt. % | 25.0 mM (1.08 wt. %) |
| Zinc dithiophosphate antiwear agent | 6.26 wt. % | 4.50 mM (0.38 wt. %) |
| Bissucinimide dispersant | 49.83 wt. % | 3.00 wt. % |
| 2,6-Di-tert-butyl-p-cresol antioxidant | 12.46 wt. % | 0.75 wt. % |
| Polyoxyalkylene glycol demulsifier | Various amounts[1] | Various amounts[1] |
| Diluent Oil | wt. % to bring the total to 100 wt. % | |
| Base Oil | | wt. % to bring the total to 100 wt. % |

[1]See Table 3

Oil A concentrate has a sulfated ash content of less than 8.5 wt. % (0.51 wt. % in finished oil), a phosphorus content of about 0.46 wt. % (0.013 wt. % in finished oil), a sulfur content of about 1.76 wt. % (0.11 wt. % in finished oil), and a TBN of about 49 to 56. Various amounts of demulsifiers were added to Oil A, and corresponding amounts of diluent oil (to the concentrate) and base oil (to the finished oil) were also added to the mixture to bring the total amount of the lubricating oil compositions to 100 wt. %.

TABLE 2

| Oil B | | |
|---|---|---|
| Components | Concentration in the Concentrate | Concentration in the Finished Oil |
| Bissuccinimide ashless dispersant | 33.48 wt. % | 2.648 wt. % |
| Low overbased sulfonate detergent | 4.31 wt. % | 2.00 mM (0.34 wt. %) |
| Overbased & sulfurized | 37.55 wt. % | 31.5 mM (2.97 wt. %) |

TABLE 2-continued

| Oil B | | |
|---|---|---|
| Components | Concentration in the Concentrate | Concentration in the Finished Oil |
| calcium phenate detergent | | |
| Zinc dithiophosphate antiwear agent | 4.84 wt. % | 4.50 mM (0.38 wt. %) |
| Hindered phenolic propionate ester antioxidant | 9.20 wt. % | 0.728 wt. % |
| Silicon based foam inhibitor | 0.32 wt. % | 5.00 ppm |
| Polyoxyalkylene glycol demulsifier | Various amounts[2] | Various amounts[2] |
| Diluent Oil | wt. % to bring the total to 100 wt. % | |
| Base Oil | | wt. % to bring the total to 100 wt. % |

[2]See Tables 3, 4, and 5

Oil B concentrate has a sulfated ash content of about 6.4 wt. % (0.51 wt. % in finished oil), a phosphorus content of about 0.352 wt. % (0.03 wt. % in finished oil), and sulfur content of about 2.609 to 3.125 wt. % (0.21 to 0.25 wt. % in finished oil), preferably of about 2.867 wt. % (0.23 wt. % in finished oil), and a TBN of about 56. Various amounts of demulsfifiers were added to Oil B, and corresponding amounts of diluent oil (to the concentrate) and base oil (to the finished oil) were also added to being the total amount of the lubricating oil compositions to 100 wt. %.

The demulsibility tests were performed at 24° C. with one part of 40 ml of distilled water and another part of 40 ml of the oil samples. The oil and water mixtures were stirred at 1,500 rpm. The levels or amounts of emulsion were reported at 5 minute intervals for 30 minutes.

The results of the demulsibility tests are summarized in Table 3:

TABLE 3

| Samples | Oil (ml) | Aqueous (ml) | Emulsion (ml) | Pass/ Fail Scores |
|---|---|---|---|---|
| Oil A + no demulsifier | 0 | 0 | 80 | Fail |
| Oil A + 0.25 wt. % demulsifier | 43 | 37 | 0 | Borderline fail |
| Oil B + 0.1 wt. % demulsifier | 42 | 38 | 0 | Borderline pass |
| Oil B + 0.25 wt. % demulsifier | 40 | 40 | 0 | Pass |

Example 2

Oil B was used in this example. Compared to Example 1 above, an inlet brine solution rather than distilled water was mixed with the oil samples before testing. The brine solution was employed to simulate the actual components of the emulsions in the dehydrators. Equal volumes of the brine solution and the oil samples were mixed. The time to stable phase separation was also recorded. The results are summarized in Table 4.

TABLE 4

| Samples | Oil (ml) | Aqueous (ml) | Emulsion (ml) | Time to stable separation |
|---|---|---|---|---|
| Oil B + 0.25 wt. % demulsifier | 55 | 25 | 0 | 60 min |
| Oil B + 0.50 wt. % demulsifier | 56 | 24 | 0 | 5 min |
| Oil B + 0.75 wt. % demulsifier | 58 | 22 | 0 | 5 min |
| Oil B + 1.0 wt. % demulsifier | 54 | 26 | 0 | 5 min |
| Oil B + no demulsifier | 0 | 0 | 80 | >60 min |

Example 3

Oil B was used in this example. Compared to Example 2 above, rather than using equal volumes of brine solution and oil, a 70-ml brine solution and a 10-ml oil sample were mixed to more closely simulate the typical brine-compressor oil concentrations in the dehydrators and other downstream components. The results are summarized in Table 5:

TABLE 5

| Samples | Oil (ml) | Aqueous (ml) | Emulsion (ml) | Time to stable separation |
|---|---|---|---|---|
| Oil B + 0.25 wt. % demulsifier | 22 | 58 | 0 | 75 min |
| Oil B + 0.50 wt. % demulsifier | 18 | 62 | 0 | 40 min |
| Oil B + 0.75 wt. % demulsifier | 14 | 66 | 0 | 5 min |
| Oil B + 1.0 wt. % demulsifier | 13 | 67 | 0 | 5 min |
| Oil B + no demulsifier | ~53 | ~27 | Difficult to measure | Phase separation exists but difficult to detect |

What is claimed is:

1. A method of inhibiting the formation of emulsions in a natural gas dehydrator comprising lubricating one or more gas compressors and natural gas engines that power the one or more compressors with a lubricating oil composition comprising: (a) a major amount of a base oil of lubricating viscosity, (b) one or more detergents, (c) one or more dispersants, (d) one or more antioxidants, (e) one or more anti-wear agents, and (f) one or more demulsifiers in an amount effective to remove or reduce the formation of emulsions in the dehydrator, wherein the compressors and the engines that power those compressors are at or near a natural gas wellhead and are situated upstream from the dehydrator in a natural gas processing system.

2. The method of claim 1, wherein the lubricating oil composition further comprises one or more of viscosity index improvers, corrosion inhibitors, lube oil flow improvers, rust inhibitors, pour point depressants, anti-foam agents, seal swellants, friction modifiers, extreme-pressure agents, color stabilizers, wetting agents, bactericides, and additive solubilizers.

3. The method of claim 1, wherein the amount of the one or more demulsifiers in the lubricating oil composition is from about 0.01 to 2.0 wt. %, based on the total, weight of the lubricating oil composition.

4. The method of claim 3, wherein the amount of the one or more demulsifiers in the lubricating oil composition is from about 0.1 to about 1.0 wt. % based on the total weight of the lubricating oil composition.

5. The method of claim 1, wherein the one or more demulsifiers are of the low-ash variety.

6. The method of claim 1, wherein the one or more demulsifiers are of the ashless variety.

7. The method of claim 6, wherein the one or more ashless demulsifiers are selected from nitrogen-containing demulsifiers, phosphate-containing demulsifiers, polyalkylene glycols, and polyalkylene glycol derivatives.

8. The method of claim 7, wherein at least one of the demulsifiers is a polyalkylene glycol.

9. The method of claim 1, wherein the one or more antioxidants are selected from hindered phenols, alkaline earth metal salts of alkylphenolthioesters, calcium nonylphenol sulfides, ashless oil-soluble phenates, ashless oil-soluble sulfurized phenates, phosphosulfurized or sulfurized hydrocarbons, phosphorous esters, metal thiocarbamates, oil-soluble copper compounds, and amino-containing compounds.

10. The method of claim 1, wherein the one or more antiwear agents are a dihydrocarbyl dithiophosphate metal salt.

11. The method of claim 1, wherein the one or more dispersants are ashless.

12. The method of claim 11, wherein the one or more ashless dispersants are selected from the group consisting of oil-soluble salts, esters, amino esters, amines, imides, oxazolines of long-chain hydrocarbon substituted mono- and dicarboxylic acids or their anhydrides; thiocarboxylate derivatives of long-chain hydrocarbons, long-chain hydrocarbons having an attached polyamine, and Mannich condensation products.

13. The method of claim 12, wherein the one or more ashless dispersants are a bissuccinimide.

14. The method of claim 11, wherein the amount of the one of more ashless dispersants in the lubricating oil composition is about 1 to 5 wt, % based on the total weight of the lubricating oil composition.

15. The method of claim 14, wherein the amount of the one or more ashless dispersants in the lubricating oil composition is about 2 to 4 wt, %, based on the total weight of the lubricating oil composition.

16. The method of claim 1, wherein the one or more detergents are a metal-containing detergent.

17. The method of claim 16, wherein the metal-containing, detergent is overbased.

18. The method of claim 17, wherein the overbased metalcon mg detergent is a salt of an alkali or an alkaline earth metal.

19. The method of claim 2, wherein the foam inhibitor is a silicon-based foam inhibitor.

* * * * *